US006330935B1

(12) United States Patent
Systermans

(10) Patent No.: US 6,330,935 B1
(45) Date of Patent: Dec. 18, 2001

(54) MAINTENANCE METHOD FOR AN ELEVATOR INSTALLATION AND ELEVATOR INSTALLATION

(75) Inventor: Ralf Systermans, Letter (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/612,241

(22) Filed: Jul. 7, 2000

Related U.S. Application Data

(63) Continuation of application No. PCT/DE99/00085, filed on Jan. 11, 1999.

(30) Foreign Application Priority Data

Jan. 9, 1998 (DE) ..... 198 00 714

(51) Int. Cl.[7] ..... B66B 3/00
(52) U.S. Cl. ..... 187/391; 702/184
(58) Field of Search ..... 187/391, 393, 187/247, 414; 702/179, 180, 182, 183, 184, 185; 340/3.43, 3.44

(56) References Cited

U.S. PATENT DOCUMENTS

| | | | | |
|---|---|---|---|---|
| 3,973,648 | * | 8/1976 | Hummert et al. | 187/29 R |
| 4,418,795 | * | 12/1983 | Trosky et al. | 187/29 R |
| 4,512,442 | * | 4/1985 | Moore et al. | 187/29 R |
| 4,697,243 | * | 9/1987 | Moore et al. | 187/133 |
| 4,823,914 | * | 4/1989 | McKinney et al. | 187/133 |
| 4,930,604 | * | 6/1990 | Schienda et al. | 187/133 |
| 5,557,546 | * | 9/1996 | Fukai et al. | 187/391 |
| 5,736,694 | * | 4/1998 | Ketoviita | 187/391 |

FOREIGN PATENT DOCUMENTS

| | | |
|---|---|---|
| C2-2928463 | 2/1981 | (DE) . |
| C2-3739660 | 6/1989 | (DE) . |
| A2653371 | 5/1995 | (EP) . |
| A6345348 | 4/1995 | (JP) . |
| A8333065 | 4/1997 | (JP) . |
| A9240946 | 9/1997 | (JP) . |

* cited by examiner

*Primary Examiner*—Jonathan Salata

(57) ABSTRACT

The present invention relates to an elevator system for which maintenance is tailored for each of the individual hardware components of the elevator. A maintenance system groups together hardware components having approximately identical maintenance needs, and stores these groups along with the appropriate maintenance data for these groups in a storage area. The maintenance data stored in connection with each group includes maintenance time-points that indicate the times when the group of components should be maintained. The storage area of the maintenance system can be accessed and changed by remote devices. Components needing more maintenance are store in different groups from components needing less maintenance, thereby reducing unnecessary maintenance of elevator components.

23 Claims, 2 Drawing Sheets

MAINTENANCE METHOD FOR AN ELEVATOR INSTALLATION AND ELEVATOR INSTALLATION

This application is a Continuation of PCT International Application No. PCT.DE99/00085 filed on Jan. 11, 1999, which designated the United States and on which priority is claimed under 35 U.S.C. §120, the entire contents of which are hereby incorporated by reference.

FIELD OF THE INVENTION

The present invention relates to an elevator system having a maintenance system and a method for maintaining an elevator system.

BACKGROUND OF THE INVENTION

Until now, for the maintenance of an elevator system, there have been set maintenance intervals, causing more or less extensive maintenance service to be performed than was required. This led to the situation where elevator components needing less maintenance would be serviced too often, because the service intervals were oriented to meet the requirements to the maintenance-intensive hardware components of the elevator. Thereby, unnecessary maintenance was undertaken, which then increased the maintenance cost of the elevator system.

SUMMARY OF THE INVENTION

It is therefore the object of the present invention to create an elevator system and a method for maintaining an elevator system, so that the maintenance is tailored for each of the individual hardware components of the elevator.

This task is performed through an elevator system according to claim 1 and a method for maintaining an elevator system according to claim 8. Advantageous improvements of the invention are subject matter to the appropriate dependent claims.

According to the invention, hardware components for the definition of the maintenance intervals are sectioned into groups, wherein either the hardware components have an approximate identical maintenance need or comprise similar spatial and/or technically connected hardware components. For these different groups, different maintenance intervals are stored in a storage area of the maintenance system as maintenance data, which can be accessed through an input or a remote input device. The maintenance system can be a part of the elevator control or it can be separate. It is also possible to compound the maintenance systems of plural elevators arranged in a group. The hardware components of the elevator combined in one of the maintenance groups are hereinafter referred to as maintenance modules. Through an elevator and client specific definition of these modules, the wishes of the client can be fulfilled in that through the hardware components of the elevator system a preset value of the environment can be calculated, so that an optimized individual client and elevator specific maintenance with minimal maintenance expenditure is possible.

When, for example, the modules are defined in such a manner, so that their respective hardware components are combined with relatively similar sized maintenance requirements, therefore the maintenance-intensive and greater wear-and-tear hardware components of the elevator are more often maintained than the hardware components in the modules with lower maintenance needs.

It is self-evident that the hardware components of the elevator and the maintenance modules can also be selected through other criteria. One criteria can be, for example, a spatial layout. Through so-called defined maintenance modules, an organized maintenance schedule is possible which then leads to lower maintenance costs. In this implication, for example, a standard group of hardware components, which need to be examined, can be combined into one base module. Such a maintenance module can combine all of the maintenance tasks, which include for example, a visual inspection of the elevator cabin, the elevator shaft, the control cabinet, and the cable and the towing rope. This base module can futhermore be utilized for examining the acceleration tolerances and for acquisition of the subjective status of the elevator system. One base module, for example, can be a root maintenance module that has a two-month interval stored in a storage area of the maintenance system. This module would store the hardware components and the maintenance-related work of the hardware components, combined with the time point for performing the maintenance work.

In the case of the base module, there could be for example a two-month maintenance interval, and other maintenance modules could then be overlaid. Conceivably, there could be a drive module, i.e., a maintenance group that encompasses all greasing, cleaning, and examining work on hardware components of the drive. Furthermore, a door module that encompasses all of the door components and the appropriate maintenance work. Further conceivable would be for example a shaft module which encompasses all hardware components in the shaft, e.g., guide rails, cable, switches, drive head guide, counterweight guide, catching device, cable tension and the buffer, and also the associated maintenance work, greasing, cleaning and checking. A further maintenance module could be an electric module, which would focus on the cleaning and checking of all the electrodes and connections in the elevator. While the base module in the above example can be carried out in two-month intervals, the other maintenance modules such as the drive module, door module, shaft module or the electrical module can be carried out in larger time intervals. The drive module can, for example, be examined after every third base module; the door module with every fourth base module interval; and the shaft module with every fifth base module interval.

After the completion of every maintenance module, through an input device or through a remote input, the corresponding maintenance module is reseted or acknowledged. If that does not happen, the maintenance system executes an alarm signal after the predetermined maintenance time point is transgressed. The alarm signal can, for example, be directed through a remote guide and delivered into a central maintenance center.

It is understandable that predetermined maintenance intervals are not set. They can be varied into a preferable completion form of the invention through sensors, which check the condition or the settings of the different hardware components. In this manner, there can be many hardware components of the elevator that have sensors, which supply information about the settings and/or the wear-and-tear of the hardware components to the control and/or the maintenance system. These signals can be used to move a maintenance interval in a group either further forward or further backward, depending on the individual status of the time dependent hardware components in the group, respectively in the module. Understandably, the date for the completion of one of the maintenance modules can also be shifted through a manual input, when for example, an unplanned maintenance is performed on certain hardware components.

When maintenance time points are shifted because of sensor data, the maintenance system combines the time points from adjacent maintenance modules together, so that there are no unnecessary driving costs because of maintenance modules which have relatively dense time points.

The control and/or maintenance system has a clock so that it remains in contact with a comparator to generate a time check between the actual time and the time point in which the maintenance module needs to be performed, and by the transgression of an alarm signal.

Through a remote input device, the time points for the maintenance modules can be coordinated with further maintenance monitoring provisions, for instance, the examining work of a technical examining society or union.

When, for example, a hardware component is replaced during repair work, this is inputted into a maintenance-friendly execution form of the invention through an input device in the maintenance system, which thereupon takes out that hardware component out of that or the next following maintenance module, so that unnecessary maintenance work is hindered.

Next to pure maintenance modules, the hardware components can be combined in connection with the required cleaning work in groups, the so-called cleaning modules. These cleaning modules can be completed together with the maintenance modules at predetermined time points, respectively, time intervals in the storage capacity of the maintenance system, respectively, the elevator controls.

Further, still other objects of the present invention will become more readily apparent in light of the following detailed description when taken in conjunction in with the accompanying drawing in which:

DETAILED DESCRIPTION OF THE PREFERRED EMBODIMENTS AND BEST MODE

Figure 1:
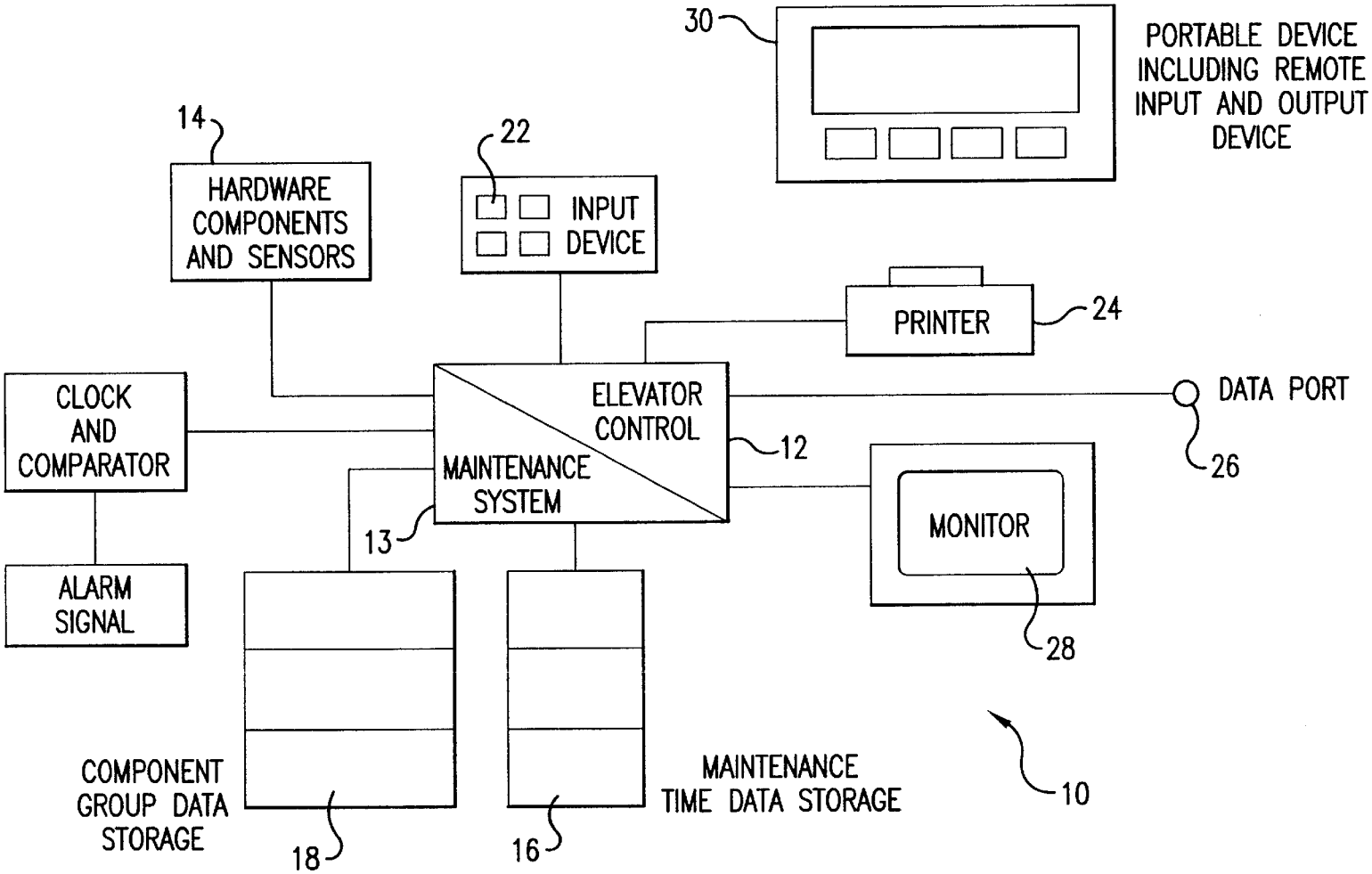
FIG. 1 is a block diagram of an elevator system with a module maintenance system.

FIG. 1 shows an elevator system 10, comprising an elevator control 12 with a maintenance system 13. Connected with the elevator control 12 are hardware components 14 of the elevator system, such as a plurality of elevators and their electrical or mechanical components, which also are components of the control 12 itself. The hardware components 14 of the elevator system have sensors, which transmit signals according to the status of the settings of the components to the central control 12. The maintenance system further comprises two storage areas, 16 and 18, wherein the storage area 16 maintenance time data are organized in groups (and modules) of the hardware components, in which the groups are, for example, the base module (BM), the door module (TM) and the drive module (AM), which are exactly specified in the storage area 18 (see also, FIG. 2). In the diagram, each of three maintenance modules BM, TM and AM are stored with their maintenance time data in the storage area 16. In the storage area 18, besides storing the hardware components, the hardware corresponding maintenance work can be stored. The art of compiling the modules in the storage area 18 is determined through individual client wishes and through the type of the installed elevator. The corresponding time data 16 of the maintenance module 18 can be changed through the sensor data from the hardware components 14 by means of the maintenance system in the elevator control 12, wherein each of the closely successive different time data of the maintenance module are replaced through an identical maintenance date, to hinder closely successive maintenance work and their accompanying driving costs.

The control 12 and/or the maintenance system 13 further comprises an input device 22, printer 24, a port 26 for data sending, and a monitor 28. The maintenance system and the input and output devices 22, 24 and 28 can principally also be installed in a maintenance central of the elevator operators, so that locally no input and output devices are necessary. Furthermore, the input and output device with the maintenance system can be eventually portable device which the maintenance personal can carry around.

Dependent on the client, the system specific definition and input of the maintenance module and their respective maintenance time data in the storage area 18 and 16, are checked by the central control 12 or the maintenance system 13, the operation of the maintenance modules are checked with a comparison of the actual system time, which can be through a battery buffered radio clock actualized. Through signals from the hardware components 14, the maintenance time data can be changed intern. A notice of the change of the maintenance data can be given over the remote transmitting feature 26 to a maintenance central, including the entire module maintenance plan, the contents of the storage area 16 and 18. Prior to a system intern change of the maintenance time dates because of a signal from a hardware component 14, there can for example, be a acknowledgement of a maintenance time change, which can be asked prior at the maintenance central via the data remote transmitting. On location and/or in the maintenance central are input and output devices available, through which the configuration of the maintenance module can be called, as well as the definition of the maintenance modules input can also be taken. In this manner, the maintenance plan of the elevator system can be changed and can be appropriately adapted, for example, because of elevator modernizing.

Figure 2:
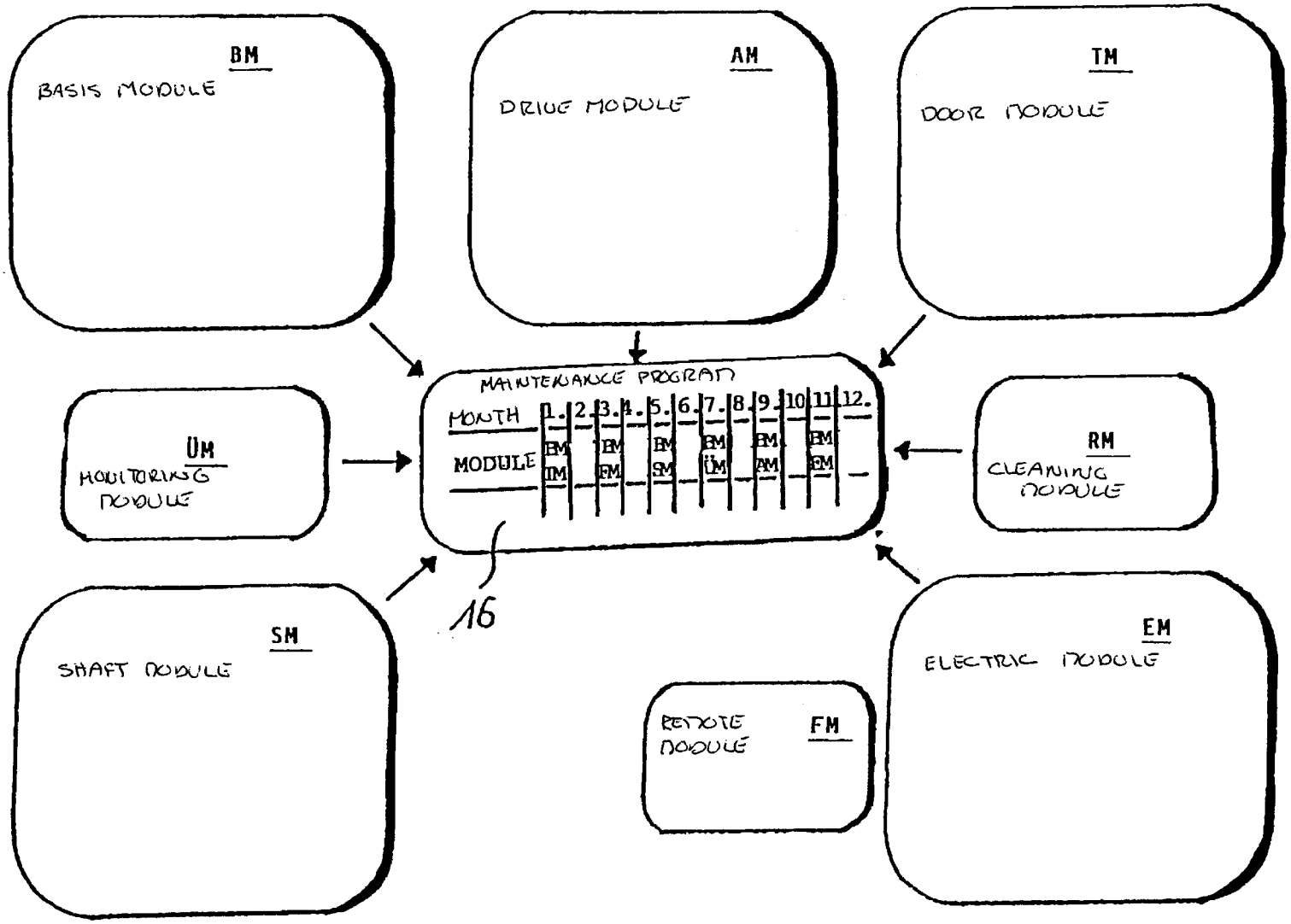
FIG. 2 is a block schematic diagram of a storage area of the maintenance system with different maintenance modules.

An example of a module maintenance plan is shown in FIG. 2. In the maintenance plan, there are five different maintenance modules combined through technical corresponding hardware components. On the top left is a base module (BM) with a standard maintenance work defined, which is the first on a site inspection touched. To the right is a drive module (AM) defined, which specified the maintenance work onto all the relevant portions of the electrical drive. To the top right is a door module (TM) defined, which combines all of the maintenance work in connection with the hallway and cabin elevator doors. On the bottom right, an electric module (EM) is defined, in which the maintenance work is contained for the electrical system of the elevator system. On the left, the shaft module (SM) defined, which contains all maintenance, examination, and cleaning work for the elevator shaft area. For these different maintenance modules (BM, TM, AM, EM, and SM) which according to FIG. 1 of the elevator system, are stored in the storage area 18, are maintenance intervals defined which are stored in the storage area 16. Therefore, the storage area 16 contains the order of the modules according to the maintenance time points, i.e., intervals. Understandably, the number and art of the modules are not limited. It is possible to incorporate monitoring modules or remote modules, which can either monitor the elevator on location or through remote monitoring, and cleaning modules which not only have maintenance cycles, but also encompass cleaning cycles of the assigned group of the hardware components of the elevator. Furthermore, there can also be an elevator personnel module, which refers to functions of the maintenance personnel or the superintendent, like for example, briefings and appointments.

The maintenance system 13 can be interconnected with the control or can be a portion of the control. It can also be in the maintenance central of the elevator manufacture or the Maintenance Company, together with the associated storage 16 and 18. In this case, the elevator system has an interface for exchanging data with the maintenance system. The essential components of the maintenance system can be arranged in a mobile unit, thereby allowing personnel on location to connect into the elevator system.

The sensors which deliver signals from the hardware components 14, to the control 12 or the maintenance system, can comprise ride counters, brake counters, wear-pointers of any kind, internal check data of the control and safety-zone information, just to name a few.

What is claimed is:

1. A method for maintaining an elevator system with at least a data-storage exhibiting maintenance system, the method comprising:

combining the hardware components with similar maintenance needs or the spatially and/or technically connected hardware components of the elevator into groups;

assigning the different groups specific maintenance time-points so that a group specific maintenance plan is rendered in a data storage of the maintenance system for an elevator.

2. The method according to claim 1, wherein the maintenance time-point of the module can be changed through an input or a remote input device.

3. The method according to claim 1, wherein the maintenance system receives sensor signals from hardware components of the elevator, wherein at least the time of the next maintenance time-point of a group corresponding to a hardware component is changed based on the sensor signal from the hardware component.

4. The method according to claim 1, wherein two closely timed maintenance time-points of two modules are combined and stored by a new generated maintenance time-point.

5. The method according to claim 8, wherein in a storage area of the data storage of the maintenance system, the specific maintenance functions for the groups of hardware components are stored.

6. The method according to claim 1, wherein the hardware components included in a group can be designated or changed through an input device or a remote input device.

7. The method according to claim 1, wherein the maintenance system receives data, which is input through an input device or transmitted from a remote input device, and wherein at least the time of the next maintenance time-point of a group of hardware components is changed based on the received data.

8. The method according to claim 1, further comprising the step of:

accessing the group specific maintenance plan in the data storage of the maintenance system from a remote location.

9. An Elevator system comprising:

an elevator including hardware components; and a maintenance system for organizing the hardware components into a plurality of groups and providing a maintenance plan assigning each of the plurality of groups with at least one maintenance time-point, the maintenance scheduling system including a first data storage for storing information regarding the hardware components associated with each of the plurality of groups, and a second data storage for storing the at least one maintenance time-point corresponding to each of the plurality of groups.

10. An Elevator system according to claim 9, wherein the hardware components are organized into the plurality of groups such that hardware components are grouped together according to at least one of: similar maintenance needs, similar spatial characteristics, and similar technical characteristics.

11. An Elevator system according to claim 9, wherein the maintenance system further includes an input device or remote input device for designating the hardware components to be included in each of the plurality of groups.

12. An Elevator system according to claim 9, wherein the maintenance system further includes a unit that organizes the hardware components into a plurality of groups based on a type of the elevator.

13. An Elevator system according to claim 9, wherein the first storage area further stores maintenance work to be done corresponding to each of the plurality of groups.

14. An Elevator system according to claim 9, wherein the maintenance system further includes a unit for receiving data, which is input through an input device or transmitted from a remote input device, and shifting one or more of the maintenance time-points according to the received data.

15. An Elevator system according to claim 9, wherein the hardware components of the elevator are furnished with at least one sensor whose signal pertains to the setting and/or wear of one of the hardware components, and wherein the maintenance system includes a unit for shifting the at least one maintenance time-point assigned to a group corresponding to a particular hardware component, based on a sensor signal pertaining to the particular hardware component.

16. An Elevator system according to claim 9, wherein the maintenance system further includes an input device or remote input device for inputting information regarding the completion of maintenance for a group of hardware components, and wherein the maintenance system includes a unit for acknowledging the completion of maintenance corresponding to a maintenance time-point for a group of hardware component based on the information input through the input device or remote input device.

17. An Elevator system according to claim 16, wherein the maintenance system includes a unit for shifting the at least one maintenance time-point assigned to a group of hardware components based on an acknowledgement by the acknowledging unit corresponding to the group.

18. An Elevator system according to claim 16, wherein the maintenance system includes a clock and a comparator, which generates an alarm signal when the actual time passes a maintenance time-point assigned to a group of hardware components, without the maintenance system acknowledging completion of maintenance corresponding to the maintenance time-point.

19. An Elevator system according to claim 9, further including a control unit which is furnished with a remote transmitting feature, with which data stored in the first and second data storage, including the maintenance time-points, is transmitted onto an external read or analysis unit.

20. An Elevator system according to claim 9, wherein the maintenance system replaces closely successive maintenance time-points corresponding to two or more groups of hardware components with identical maintenance time-points.

21. The method according to claim 1, further comprising the steps of:

performing maintenance corresponding to a maintenance time-point assigned to a group of hardware components;

resetting or acknowledging said maintenance time-point in response to completing the step of performing maintenance.

22. The method according to claim 21, wherein an alarm is generated from the maintenance system, when a maintenance time-point passes with resetting or acknowledging the maintenance time-point.

23. The method according to claim 16, wherein at least the time of a next maintenance time point of a group of hardware components is changed based on the resetting or acknowledging of a time-point assigned to the group.

* * * * *